US009899782B2

(12) United States Patent
Urano

(10) Patent No.: US 9,899,782 B2
(45) Date of Patent: Feb. 20, 2018

(54) CONNECTOR ASSEMBLY AND CONNECTOR ASSEMBLY MOUNTED STRUCTURE

(71) Applicant: Japan Aviation Electronics Industry, Limited, Tokyo (JP)

(72) Inventor: Tetsu Urano, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/454,565

(22) Filed: Mar. 9, 2017

(65) Prior Publication Data

US 2017/0352996 A1 Dec. 7, 2017

(30) Foreign Application Priority Data

Jun. 2, 2016 (JP) ..... 2016-111062

(51) Int. Cl.

| | |
|---|---|
| ***H01R 13/60*** | (2006.01) |
| ***H01R 24/76*** | (2011.01) |
| ***H01R 24/28*** | (2011.01) |
| *H01R 103/00* | (2006.01) |

(52) U.S. Cl.
CPC ..... *H01R 24/76* (2013.01); *H01R 24/28* (2013.01); *H01R 2103/00* (2013.01)

(58) Field of Classification Search
CPC ..... H01R 13/518; H01R 24/76; H01R 24/28; H01R 2103/00; H02G 3/14
USPC ..... 439/536, 375, 347
See application file for complete search history.

(56) References Cited

U.S. PATENT DOCUMENTS 2,180,020 A * 11/1939 Schott ..... H01R 13/71 439/536
3,955,869 A * 5/1976 Licht ..... H01R 13/114 439/218
5,230,641 A * 7/1993 Wharton ..... H01R 13/2421 439/668
5,318,453 A * 6/1994 Hwang ..... H01R 13/44 174/57
5,904,587 A * 5/1999 Osypka ..... H01R 13/62 439/263
6,004,140 A * 12/1999 Kato ..... H01R 12/7082 439/637

(Continued)

FOREIGN PATENT DOCUMENTS

JP 5258123 B2 8/2013

*Primary Examiner* — Abdullah Riyami
*Assistant Examiner* — Vladimir Imas
(74) *Attorney, Agent, or Firm* — Muncy, Geissler, Olds & Lowe, P.C.

(57) ABSTRACT

A connector assembly includes a first connector and a second connector, the first connector having a first contact and a mounting portion together with a projecting portion which passes through a through-hole of a connector holding plate to project on a side of a second face of the connector holding plate along a fitting direction when the first connector is mounted on a first face of the connector holding plate through the mounting portion, the second connector having a second contact and a second contact holding portion which has a first connector receiving portion extending along the fitting direction and an abutment portion formed at an end of the second contact holding portion on a side of the first connector and configured to be abutted against the second face of the connector holding plate.

10 Claims, 14 Drawing Sheets

(56) References Cited

U.S. PATENT DOCUMENTS 6,544,069 B1 * 4/2003 Enriquez, Sr. ..... H01R 35/04 439/534
7,862,353 B1 * 1/2011 Azad ..... H01R 13/62938 439/157
8,714,990 B2 * 5/2014 Naito ..... H01R 12/714 439/78
8,920,044 B2 * 12/2014 Shimazu ..... G02B 6/3807 385/55
8,926,336 B2 * 1/2015 Gobel ..... H01R 24/542 439/13
9,004,928 B2 * 4/2015 Tanaka ..... B60L 3/0069 439/86
9,196,981 B2 * 11/2015 Shimoji ..... H01R 12/7076
9,209,582 B2 * 12/2015 Kashiwada ..... H01R 13/6315
9,287,639 B2 * 3/2016 Kaneko ..... H01R 4/34
9,325,112 B2 * 4/2016 Tabata ..... H01R 13/62905
9,368,902 B2 * 6/2016 Nakai ..... H01R 13/5202
9,385,474 B2 * 7/2016 Kamei ..... H01R 13/502
9,413,118 B2 * 8/2016 Suzuki ..... H01R 13/6683
9,431,756 B2 * 8/2016 Kataoka ..... H01R 13/521
9,437,973 B2 * 9/2016 Kamei ..... H01R 13/633
9,484,668 B2 * 11/2016 Kamei ..... H01R 13/502
9,494,303 B2 * 11/2016 McGowan ..... H01R 4/4818
9,502,836 B2 * 11/2016 Hashiguchi ..... H01R 24/50
9,581,317 B2 * 2/2017 Meyer ..... F21V 17/10
2009/0317989 A1 * 12/2009 Daily ..... H01R 12/57 439/76.1
2009/0317990 A1 * 12/2009 Mostoller ..... H01R 12/57 439/83
2012/0040553 A1 * 2/2012 Tashiro ..... H01R 4/70 439/359
2012/0264326 A1 10/2012 Kudo et al.
2013/0163261 A1 * 6/2013 Shimoji ..... H01R 31/06 362/382
2013/0267102 A1 * 10/2013 Shimoji ..... H01R 12/7076 439/65
2014/0024230 A1 * 1/2014 Decker ..... H01R 12/73 439/65

* cited by examiner

CONNECTOR ASSEMBLY AND CONNECTOR ASSEMBLY MOUNTED STRUCTURE

BACKGROUND OF THE INVENTION

The present invention relates to a connector assembly and a connector assembly mounted structure. The present invention more particularly relates to a connector assembly in which a second connector is fitted to a first connector mounted on a connector holding plate.

A connector assembly configured to mount a first connector on a surface of a circuit board, and to fit a second connector from a rear face of the circuit board to a fitting portion of the first connector that passes through a through-hole formed in the circuit board to project from the rear face of the circuit board has conventionally been used.

For example, JP 5258123 B discloses, as a connector assembly of this type, a connector assembly including a first connector 2 mounted on a circuit board 1 and a second connector 3 to be fitted to the first connector 2 along a fitting axis C, as illustrated in FIG. 30 and FIG. 31.

The circuit board 1 has a first face 1A and a second face 1B that are oriented in opposite directions to each other. A through-hole 1C is formed in the circuit board 1. A part of the first connector 2 passes through the through-hole 1C and projects on the side of the second face 1B of the circuit board 1.

A plurality of mounting lands 1D are formed on the first face 1A of the circuit board 1 on the periphery of the through-hole 1C. A plurality of mounting portions 2A corresponding to the mounting lands 1D are formed in the first connector 2. The mounting portions 2A are soldered to their corresponding mounting lands 1D, respectively, to mount the first connector 2 on the first face 1A of the circuit board 1.

As illustrated in FIG. 32, fitting portions 2B, each of which extends along the fitting axis C and has a concave shape that is open in the fitting direction, are formed in the first connector 2. Further, convex portions 3A projecting along the fitting axis C are formed on the second connector 3. When the second connector 3 is fitted to the first connector 2 along the fitting axis C from the side of the second face 1B of the circuit board 1, the convex portions 3A of the second connector 3 are received in the fitting portions 2B of the first connector.

However, when the second connector 3 is fitted to the first connector 2, the second connector 3 is brought into abutment against the first connector 2 along the fitting axis C. Such a large force or impact as to push up the first connector 2 along the fitting axis C is thus more likely to be exerted on the first connector 2 from the second connector 3.

In such a case, such a large load as to separate the mounting portions 2A from the mounting lands 1D along the fitting axis C may be added to portions where the mounting portions 2A of the first connector 2 are soldered to the mounting lands 1D of the circuit board 1. The portions where the mounting portions 2A are soldered to the mounting lands 1D may be thus broken.

SUMMARY OF THE INVENTION

The present invention has been made to solve the above-mentioned conventional problems and an object of the present invention is to provide a connector assembly and a connector assembly mounted structure capable of preventing soldered portions from being broken during fitting.

A connector assembly according to the present invention comprises: a first connector to be mounted on a first face of a connector holding plate having the first face and a second face which are oriented in opposite directions to each other; and a second connector to be fitted to the first connector along a fitting direction from a side of the second face of the connector holding plate, wherein the first connector has a first contact and a mounting portion, and has a projecting portion which passes through a through-hole of the connector holding plate to project on the side of the second face of the connector holding plate along the fitting direction when the first connector is mounted on the first face of the connector holding plate through the mounting portion, and which includes at least a part of the first contact, wherein the second connector has a second contact and a second contact holding portion configured to hold the second contact, and the second contact holding portion has a first connector receiving portion extending along the fitting direction and an abutment portion formed at an end of the second contact holding portion on a side of the first connector and configured to be abutted against the second face of the connector holding plate, and wherein, when the second connector is fitted to the first connector from the side of the second face of the connector holding plate, at least a part of the projecting portion is received in the first connector receiving portion to bring the first contact and the second contact into contact with each other, and the abutment portion of the second contact holding portion can be abutted against the second face of the connector holding plate.

A connector assembly mounted structure according to the present invention comprises: a connector holding plate having a first face and a second face oriented in opposite directions to each other and having a through-hole formed therein; a first connector having a first contact and a mounting portion, and mounted on the first face of the connector holding plate through the mounting portion; and a second connector having a second contact and a second contact holding portion configured to hold the second contact, the second connector being to be fitted to the first connector along a fitting direction from a side of the second face of the connector holding plate, wherein the first connector has a projecting portion which passes through the through-hole of the connector holding plate to project on the side of the second face of the connector holding plate along the fitting direction and which includes at least a part of the first contact, wherein the second contact holding portion of the second connector has a first connector receiving portion extending along the fitting direction and an abutment portion formed at an end of the second contact holding portion on a side of the first connector and configured to be abutted against the second face of the connector holding plate, and wherein, when the second connector is fitted to the first connector from the side of the second face of the connector holding plate, at least a part of the projecting portion is received in the first connector receiving portion to bring the first contact and the second contact into contact with each other, and the abutment portion of the second contact holding portion can be abutted against the second face of the connector holding plate.

DETAILED DESCRIPTION OF THE INVENTION

Embodiments of the invention are described below with reference to the accompanying drawings.

First Embodiment

Figure 1:
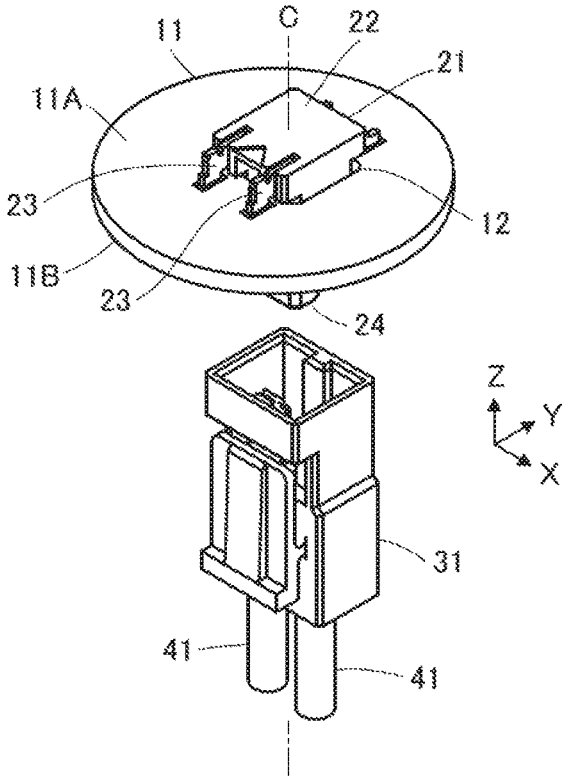
FIG. 1 is a perspective view for illustrating a connector assembly according to a first embodiment of the invention.
Figure 2:
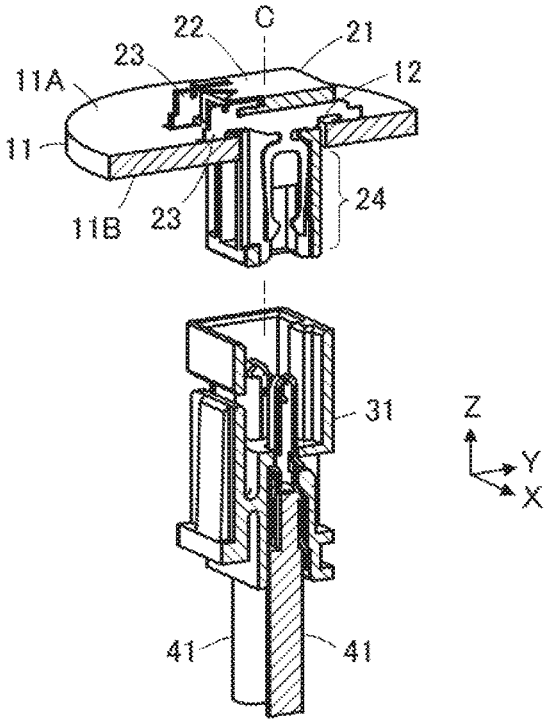
FIG. 2 is a perspective cross-sectional view of the connector assembly according to the first embodiment.

A configuration of a connector assembly according to a first embodiment is illustrated in FIG. 1 and FIG. 2. The connector assembly according to the first embodiment includes a first connector 21 mounted on a circuit board 11, and a second connector 31 to be fitted to the first connector 21 along a fitting axis C.

The circuit board 11 makes up a connector holding plate for holding the first connector 21, and has a first face 11A and a second face 11B which are oriented in opposite directions to each other. The first connector 21 is mounted on the first face 11A of the circuit board 11. Further, a through-hole 12 is formed in the circuit board 11.

The first connector 21 has a first housing 22 made of insulating resin, and two metallic conductive members 23 are held side by side in the first housing 22. For the sake of convenience, a direction in which the two conductive members 23 are disposed is called X direction, a direction away from the second connector 31 toward the first connector 21 along the fitting axis C is called +Z direction, and a direction orthogonal to the X direction and the Z direction is called Y direction.

A part of the first connector 21 passes through the through-hole 12 of the circuit board 11 and projects on the side of the second face 11B of the circuit board 11 to form a projecting portion 24.

On the other hand, two cables 41 are connected to an end of the second connector 31 in the −Z direction, respectively.

Figure 3:
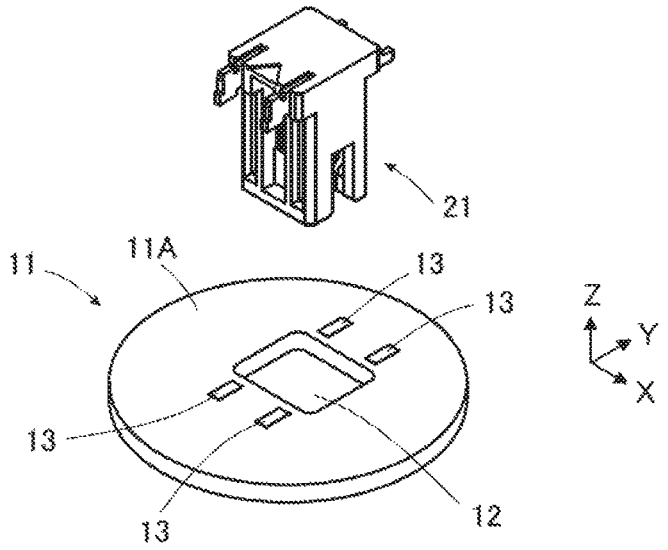
FIG. 3 is a perspective view for illustrating a first connector before being fixed to a circuit board and the circuit board.

As illustrated in FIG. 3, four mounting pads 13 are formed in advance on the periphery of the through-hole 12 on the first face 11A of the circuit board 11. These mounting pads 13 are connected to a wiring pattern (not shown) of the circuit board 11.

Figure 4:
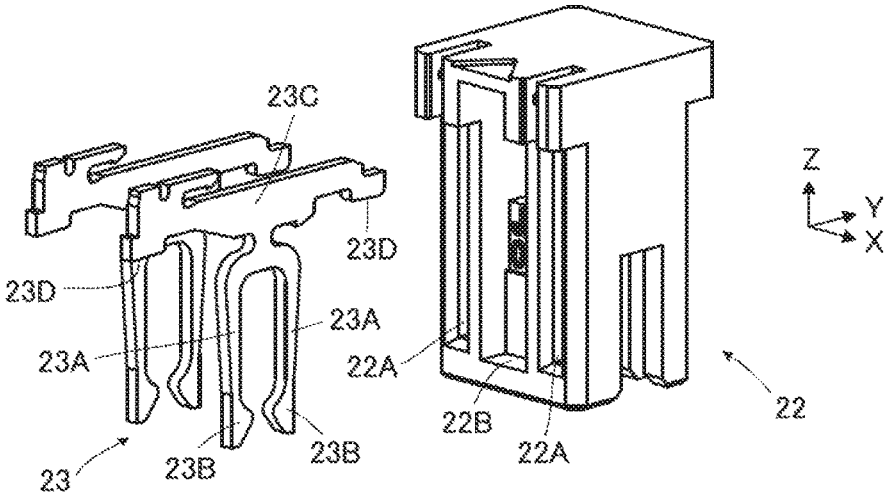
FIG. 4 is a perspective view for illustrating a first housing and conductive members before being held in the first housing.

The first housing 22 and the two conductive members 23 are illustrated in FIG. 4. The first housing 22 substantially has the shape of a rectangular parallelepiped. The first housing 22 has two conductive member insertion portions 22A formed so as to be disposed side by side in the X direction. Each of these conductive member insertion portions 22A extends to the inside of the first housing 22 so as to be located along an YZ plane. Each of the conductive member insertion portions 22A has an opening in the Y direction. An upward-facing face 22B oriented in the +Z direction is formed at an end of the first housing 22 in the −Z direction so as to be positioned between the two conductive member insertion portions 22A that are disposed side by side in the X direction.

Figure 5:
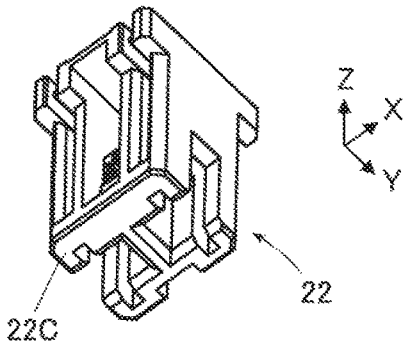
FIG. 5 is a perspective view of the first housing when viewed from below.

A lower end portion 22C is formed at the end of the first housing 22 in the −Z direction so as to be located along an XY plane, as illustrated in FIG. 5.

As illustrated in FIG. 4, each conductive member 23 has a flat shape extending along the YZ plane and includes a pair of first contacts 23A extending in the Z direction. The first contacts 23A in the pair are disposed side by side in the Y direction and are connected to each other at their ends in the +Z direction. The first contacts 23A in the pair have contact portions 23B formed at their ends in the −Z direction, respectively, the contact portions 23B projecting in the Y direction so as to face each other. Further, the first contacts 23A in the pair have elasticity and are configured to be elastically deformable on the YZ plane.

A housing holding portion 23C extending in the Y direction is connected to the ends of the first contacts 23A of the pair in the +Z direction. Mounting portions 23D oriented in the −Z direction are formed at both ends of the housing holding portion 23C in the Y direction, respectively.

The conductive members 23 are inserted into their corresponding conductive member insertion portions 22A of the first housing 22 along the Y direction, respectively, and the housing holding portions 23C of the conductive members 23 are pressed into their corresponding conductive member insertion portions 22A, respectively, whereby the two conductive members 23 are held in the first housing 22.

Figure 6:
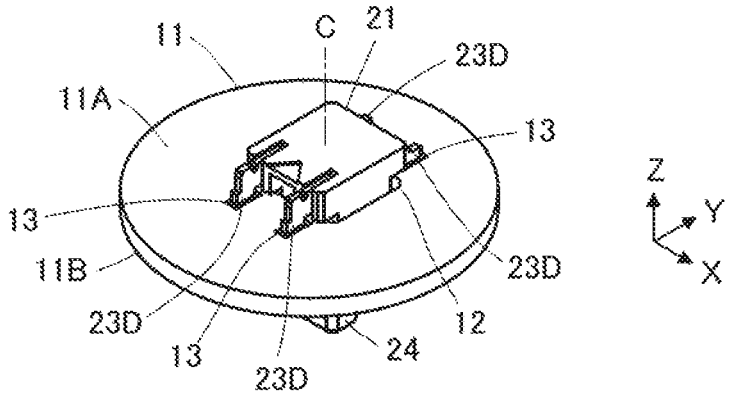
FIG. 6 is a perspective view for illustrating the first connector mounted on the circuit board.

When the first connector 21 is inserted into the through-hole 12 of the circuit board 11, as illustrated in FIG. 6, a part of the first connector 21 passes through the through-hole 12 and projects from the second face 11B of the circuit board 11 in the −Z direction to form the projecting portion 24. The projecting portion 24 is formed of a part of the first housing 22 and a part of the pair of first contacts 23A in each of the conductive members 23.

In this process, the mounting portions 23D of the two conductive members 23 are positioned on surfaces of their corresponding mounting pads 13 of the circuit board 11 and are soldered to their corresponding mounting pads 13, whereby the first connector 21 is mounted on the circuit board 11 and the conductive members 23 are electrically connected to the mounting pads 13.

Figure 7:
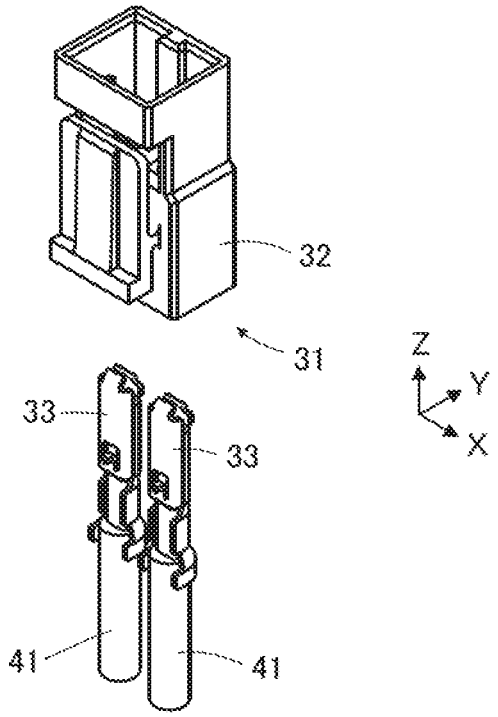
FIG. 7 is a perspective view for illustrating a second housing and second contacts before being held in the second housing.

As illustrated in FIG. 7, the second connector 31 includes a second housing 32 made of insulating resin, and two second contacts 33 made of metal and connected to ends of the cables 41, respectively. The second housing 32 makes up a second contact holding portion for holding the second contacts 33.

Figure 8A:
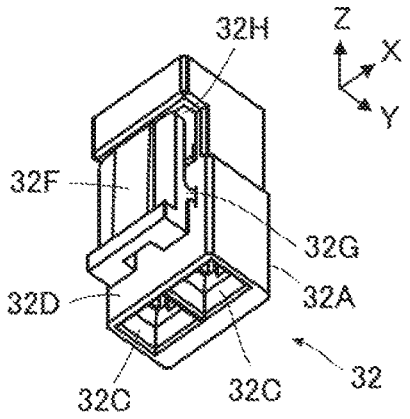
FIG. 8A is a perspective view of the second housing when viewed from a lever side and FIG. 8B is a perspective view of the second housing when viewed from a lance side.
Figure 8B:
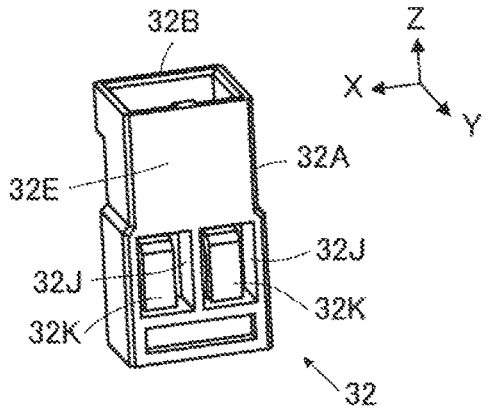

As illustrated in FIG. 8A and FIG. 8B, the second housing 32 includes a lateral wall portion 32A that has a rectangular prism shape extending in the Z direction and is open in the +Z direction, and an abutment portion 32B formed along the XY plane so as to surround the entire periphery of an opening portion of the lateral wall portion 32A.

Further, two contact insertion portions 32C that are disposed side by side in the X direction and extend in the Z direction are formed inside the second housing 32. These contact insertion portions 32C are open in the −Z direction.

The lateral wall portion 32A includes a first lateral wall 32D oriented in the −Y direction and a second lateral wall 32E oriented in the +Y direction. A lever 32F extending in the Z direction is formed on the first lateral wall 32D. The lever 32F is connected to the first lateral wall 32D through a connecting portion 32G positioned in the middle of the lever 32F in the Z direction. The connecting portion 32G has elasticity and is configured to be capable of oscillating the lever 32F on the YZ plane, the connecting portion 32G being set as the base point.

Further, a first opening 32H that is open in the −Y direction is formed in the first lateral wall 32D, and an extremity portion of the lever 32F in the +Z direction faces the first opening 32H.

Two second openings 32J that are open in the +Y direction and are disposed side by side in the X direction are formed in the second lateral wall 32E of the second housing 32. Lances 32K are formed to extend in the +Z direction from ends of the second openings 32J in the −Z direction, respectively. Each lance 32K has a cantilever shape and is configured to be elastically deformable on the YZ plane.

Figure 9A:
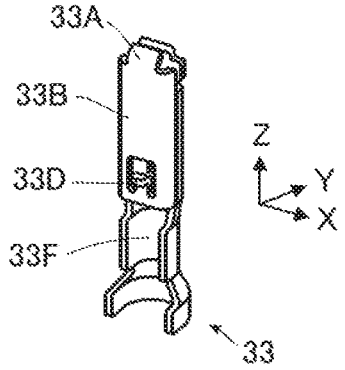
FIG. 9A is a perspective view of the second contact when viewed from a first projection side and FIG. 9B is a perspective view of the second contact when viewed from a second projection side.
Figure 9B:
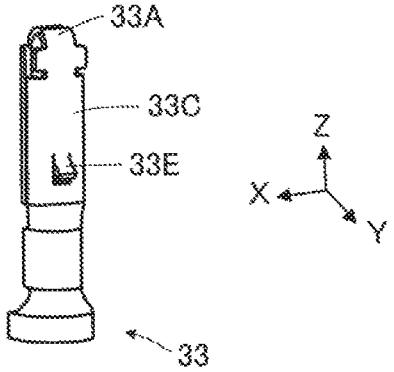

As illustrated in FIG. 9A and FIG. 9B, each second contact 33 has a substantially cylindrical shape extending in the Z direction. A guide portion 33A having a smoothly curved shape is formed at an extremity of the second contact 33 in the +Z direction.

The second contact 33 has a first connecting portion 33B oriented in the −Y direction and a second connecting portion 33C oriented in the +Y direction. The second contact 33 also has a first projection 33D formed so as to project in the −Y direction at a position on the −Z direction side with respect to the first connecting portion 33B, and a second projection 33E formed so as to project in the +Y direction at a position on the −Z direction side with respect to the second connecting portion 33C.

A cable holding portion 33F that is open in the −Y direction is formed at an end of the second contact 33 in the −Z direction.

When the second contacts 33 are connected to ends of the two cables 41, respectively, and the second contacts 33 are inserted in their corresponding contact insertion portions 32C of the second housing 32 from the −Z direction side of the second housing 32, the second projections 33E of the second contacts 33 move in the +Z direction while subjecting the lances 32K of the second housing 32 to elastic deformation in the +Y direction, and the second contacts 33 are held in the second housing 32 in a state in which the second projections 33E of the second contacts 33 are positioned on the +Z direction side of the lances 32K of the second housing 32.

Figure 11:
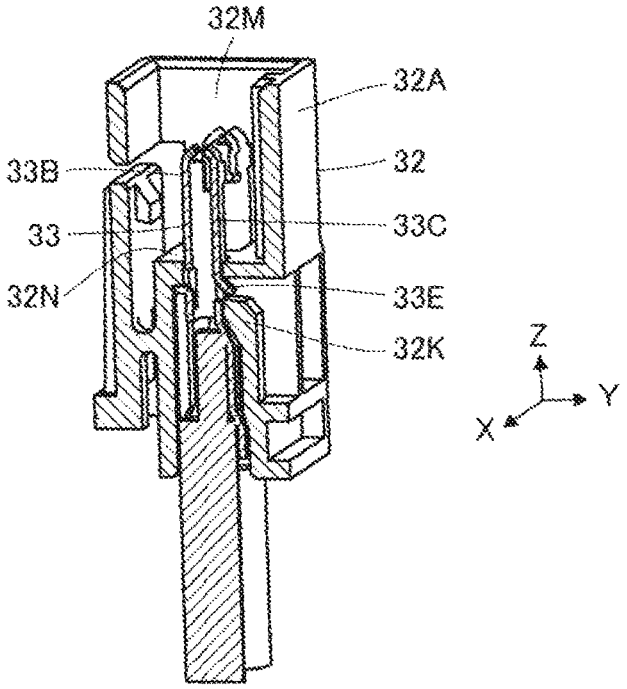
FIG. 11 is a perspective cross-sectional view for illustrating the second connector.

As illustrated in FIG. 11, a first connector receiving portion 32M extending in the Z direction is formed inside the lateral wall portion 32A of the second housing 32. A bottom portion 32N is formed at an end of the first connector receiving portion 32M in the −Z direction so as to extend along the XY plane, and the first connecting portion 33B and the second connecting portion 33C of each second contact 33 project in the +Z direction from the bottom portion 32N of the first connector receiving portion 32M.

Next, the operation of the connector assembly according to the first embodiment is described.

Figure 12:
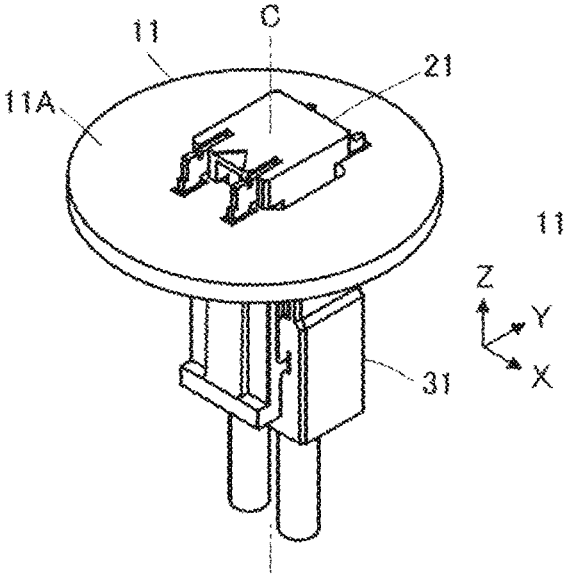
FIG. 12 is a perspective view for illustrating the connector assembly of the first embodiment after fitting and a first face of the circuit board.
Figure 13:
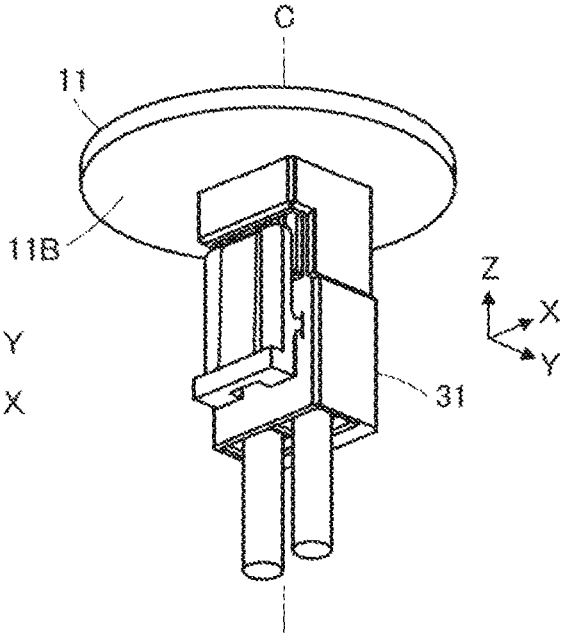
FIG. 13 is a perspective view for illustrating the connector assembly of the first embodiment after fitting and a second face of the circuit board.

When the second connector 31 is moved in the +Z direction along the fitting axis C from the second face 11B side of the circuit board 11 relative to the first connector 21 mounted on the circuit board 11, the second connector 31 is fitted to the first connector 21, as illustrated in FIG. 12 and FIG. 13.

When the second connector 31 is fitted to the first connector 21, first of all, the projecting portion 24 of the first connector 21 starts to be received in the first connector receiving portion 32M. Then, the guide portion 33A of the second contact 33 comes into contact with the pair of contact portions 23B of the conductive member 23. The guide portion 33A has a curved shape, and is hence inserted between the pair of contact portions 23B with a small force. Further, the second contact 33 advances in the +Z direction while pushing the first contacts 23A of the conductive member 23 outward, and the first connecting portion 33B and the second connecting portion 33C of the second contact 33 come into contact with the pair of contact portions 23B of the conductive member 23.

Figure 14:
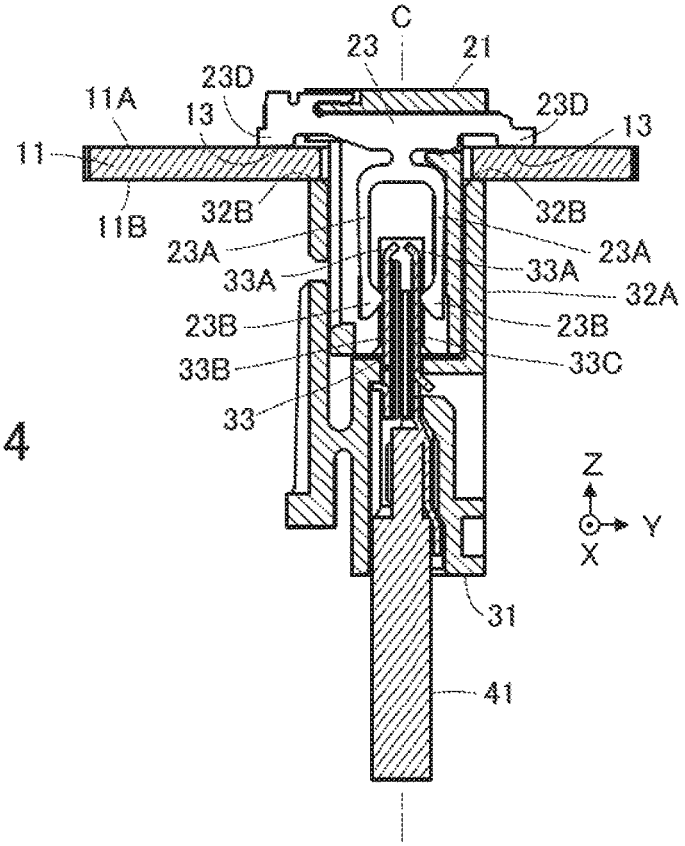
FIG. 14 is a lateral cross-sectional view of the connector assembly of the first embodiment after fitting.
Figure 15:
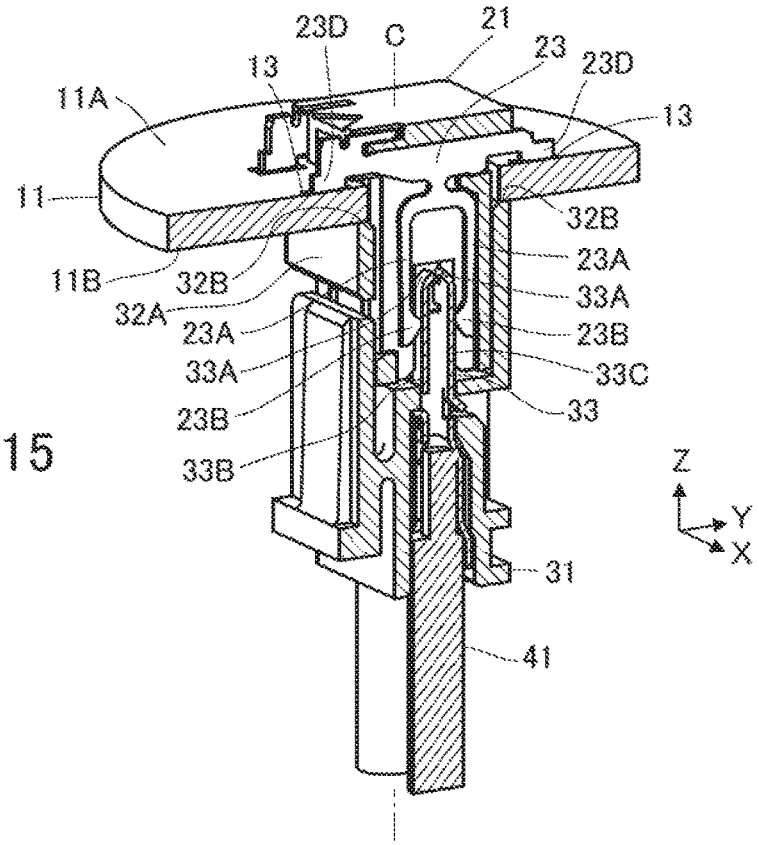
FIG. 15 is a perspective cross-sectional view of the connector assembly of the first embodiment after fitting.

Thereafter, the second connector 31 further advances in the +Z direction, and as illustrated in FIG. 14 and FIG. 15, at a point in time when the abutment portion 32B of the second housing 32 in the second connector 31 is abutted against the second face 11B of the circuit board 11, the projecting portion 24 of the first connector 21 is received in the first connector receiving portion 32M of the second connector 31 and fitting of the second connector 31 is completed.

When viewed from the fitting direction along the fitting axis C, the lateral wall portion 32A of the second housing 32 has a portion that covers the projecting portion 24 of the first connector 21 over the entire circumferential area.

Each second contact 33 is sandwiched in the Y direction between the pair of first contacts 23A of the conductive member 23 that have elasticity, and the pair of contact portions 23B formed at the first contacts 23A are in elastic contact with the first connecting portion 33B and the second connecting portion 33C of the second contact 33, respectively. The second contact 33 is thus electrically connected to the conductive member 23. At that time, the contact points between the second contact 33 and the conductive member 23 are positioned on the second face 11B side of the circuit board 11.

As illustrated in FIG. 6, the first connector 21 is mounted on a wiring pattern (not shown) of the circuit board 11 through the mounting pads 13 of the circuit board 11. Further, as illustrated in FIG. 7, the second connector 31 is connected to the cables 41. Therefore, fitting of the second connector 31 to the first connector 21 allows the cables 41 to be connected to the wiring pattern of the circuit board 11 through the first connector 21 and the second connector 31.

When the second connector 31 is fitted to the first connector 21, the abutment portion 32B of the second housing 32 in the second connector 31 is abutted against the second face 11B of the circuit board 11 over the entire circumferential area when viewed from the fitting direction along the fitting axis C.

Figure 16:
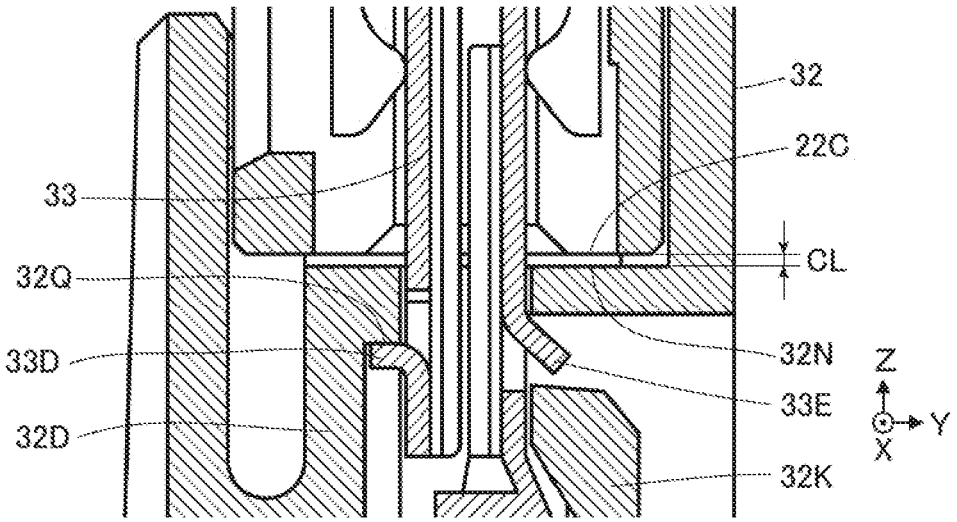
FIG. 16 is a lateral cross-sectional view of a main part of the connector assembly of the first embodiment after fitting.

FIG. 16 is a cross-sectional view of a main part of the connector assembly of the first embodiment after fitting, and is a partial enlarged view of FIG. 14. As illustrated in FIG. 16, when the second connector 31 is fitted to the first connector 21, the bottom portion 32N of the first connector receiving portion 32M in the second connector 31 does not come into contact with the lower end portion 22C of the projecting portion 24 in the first connector 21 but a clearance CL in the Z direction is formed between the bottom portion 32N and the lower end portion 22C.

The first connector 21 and the second connector 31 are configured in such a manner that a part of the projecting portion 24 of the first connector 21 that is oriented in the −Z direction does not come into contact with any part of the second connector 31 during the fitting.

Therefore, when the second connector 31 is fitted to the first connector 21, such a large force as to push up the first connector 21 in the +Z direction is prevented from being exerted on the first connector 21 from the second connector 31. As a result, a large force that causes the mounting portions 23D as soldering portions of the first connector 21 to be separated from the mounting pads 13 of the circuit board 11 in the +Z direction is not exerted on the mounting portions 23D, and the portions where the mounting portions 23D are soldered to the mounting pads 13 are prevented from being broken, whereby a reliable connector assembly can be realized.

Figure 17:
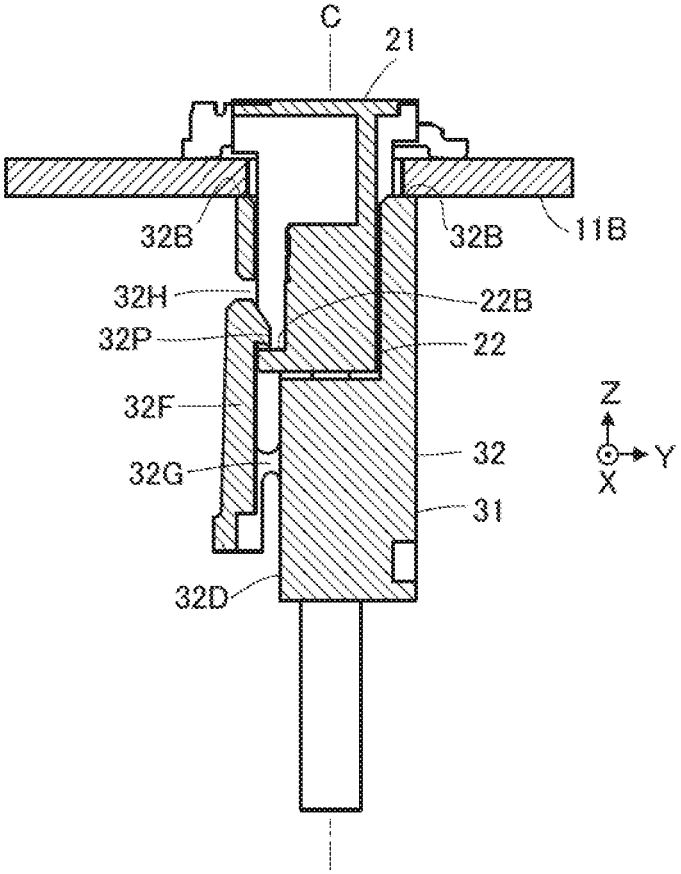
FIG. 17 is a lateral cross-sectional view for illustrating a retaining mechanism of the connector assembly according to the first embodiment.

As illustrated in FIG. 17, a pawl 32P projecting in the +Y direction so as to approach the fitting axis C is formed at an extremity in the +Z direction of the lever 32F formed on the first lateral wall 32D of the second housing 32. The pawl 32P is positioned at the first opening 32H of the second housing 32.

When fitting the second connector 31, the pawl 32P is pressed by the first housing 22 to cause elastic deformation of the connecting portion 32G, thus oscillating the lever 32F on the YZ plane to displace the pawl 32P in the −Y direction. Then, when the pawl 32P advances in the +Z direction to pass the upward-facing face 22B of the first housing 22, the pawl 32P is no longer pressed by the first connector 21 and is displaced in the +Y direction to be positioned on the +Z direction side of the upward-facing face 22B. Therefore, even when a force in the −Z direction is exerted on the second connector 31 for some reason, the pawl 32P is caught on the upward-facing face 22B to limit displacement of the second connector 31 in the −Z direction with respect to the first connector 21. Therefore, after the second connector 31 is fitted to the first connector 21, the second connector 31 is prevented from being separated from the first connector 21 in the −Z direction.

Further, in cases where the connector assembly is configured, for smooth fitting of the second connector 31 to the first connector 21, to generate a slight gap in the Z direction between the pawl 32P of the second connector 31 and the upward-facing face 22B of the first connector 21 when the abutment portion 32B of the second housing 32 in the second connector 31 is abutted against the second face 11B of the circuit board 11, the second connector 31 after the fitting may be slightly displaced in the −Z direction with respect to the first connector 21 to cause the abutment portion 32B to slightly move away in the −Z direction from the second face 11B of the circuit board 11. However, when a force in the +Z direction is exerted on the second connector 31 in this state, the abutment portion 32B would be abutted against the second face 11B of the circuit board 11. In other words, the abutment portion 32B of the second connector 31 is about to be abutted against the second face 11B of the circuit board 11. Therefore, as described above, such a large force as to push up the first connector 21 in the +Z direction is prevented from being exerted on the first connector 21 from the second connector 31, thus keeping the portions where the mounting portions 23D are soldered to the mounting pads 13 from being broken.

Figure 10:
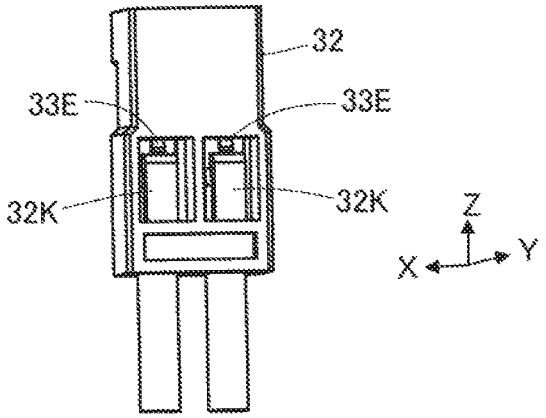
FIG. 10 is a perspective view of a second connector when viewed from behind.

After the second contacts 33 are pressed into the second housing 32 as illustrated in FIG. 10, the second projections 33E of the second contacts 33 in the second connector 31 are positioned, as illustrated in FIG. 16, on the +Z direction side with respect to the lances 32K of the second housing 32, respectively. The second projections 33E are thus caught on ends of the lances 32K in the +Z direction, and hence the second contacts 33 are prevented from being separated from the second housing 32 in the −Z direction.

Further, a downward-facing face 32Q that is oriented in the −Z direction is formed on the first lateral wall 32D of the second housing 32, and the first projections 33D are opposed to the downward-facing face 32Q. Therefore, when the second contacts 33 are inserted into the second housing 32, the first projections 33D are abutted against the downward-facing face 32Q to determine the positions of the second contacts 33 in the Z direction with respect to the second housing 32.

According to the above-mentioned first embodiment, the clearance CL in the Z direction is formed between the lower end portion 22C of the projecting portion 24 in the first connector 21 and the bottom portion 32N of the first connector receiving portion 32M in the second connector 31 when the second connector 31 is fitted to the first connector 21. However, the lower end portion 22C may come into contact with the bottom portion 32N as long as the abutment portion 32B of the second housing 32 is abutted against the second face 11B of the circuit board 11 to prevent such a large force as to push up the first connector 21 in the +Z direction from being exerted on the first connector 21. With such a configuration, the portions where the mounting portions 23D (soldering portions) are soldered to the mounting pads 13 can be also prevented from being broken.

Further, when the second connector 31 is fitted to the first connector 21, the end in the +Z direction of the lateral wall portion 32A of the second housing 32 covers the projecting portion 24 of the first connector 21 over the entire circumferential area when viewed from the fitting direction along the fitting axis C. However, the end in the +Z direction may partially cover the projecting portion 24 of the first connector 21. The abutment portion 32B of the second housing 32 would be thus abutted against the second face 11B of the circuit board 11 partially in the circumferential direction when viewed from the fitting direction along the fitting axis C. Nevertheless, exertion of such a large force as to push up the first connector 21 in the +Z direction can be suppressed to prevent the portions where the mounting portions 23D are soldered to the mounting pads 13 from being broken.

The first connector 21 has the two conductive members 23 and the second connector 31 has the two second contacts 33 so as to be adapted to the first connector 21. However, this is not the sole case. More specifically, the first connector 21 may have one conductive member 23, or three or more conductive members 23. Further, the second connector 31 may have one second contact 33 or three or more second contacts 33 so as to be adapted to the first connector 21.

Second Embodiment

According to the first embodiment, the first connector 21 includes the first housing 22 made of insulating resin and the conductive members 23 made of metal, and the second connector 31 includes the second housing 32 made of insulating resin and the second contacts 33 made of metal. However, this is not the sole case. According to a second embodiment, each of the first connector and the second connector includes a single metal member.

Figure 18:
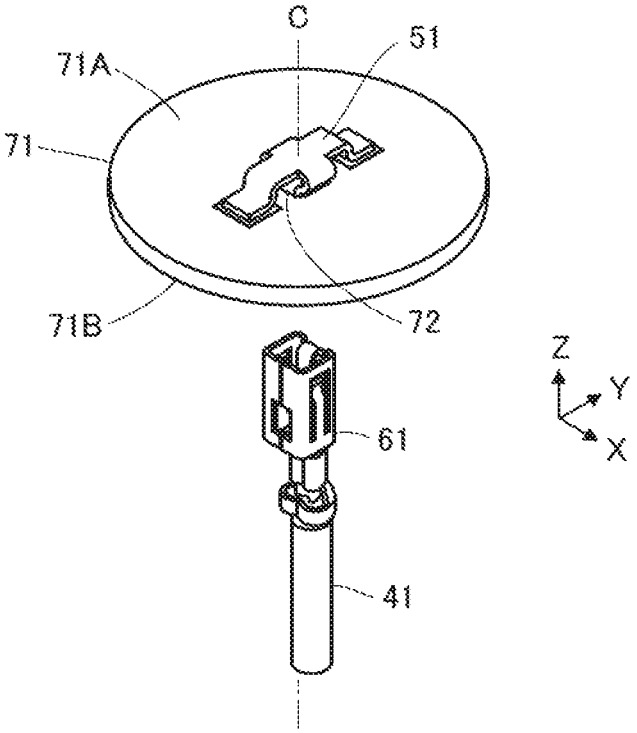
FIG. 18 is a perspective view for illustrating a connector assembly according to a second embodiment of the invention.

A connector assembly according to the second embodiment is illustrated in FIG. 18. The connector assembly according to the second embodiment includes a first connector 51 made of metal and mounted on a circuit board 71, and a second connector 61 made of metal to be fitted to the first connector 51 along the fitting axis C. The circuit board 71 makes up a connector holding plate for holding the first connector 51, and a through-hole 72 is formed in the circuit board 71.

The circuit board 71 illustrated in FIG. 18 is configured in the same manner as the circuit board 11 in the first embodiment except that the through-hole 72 is formed instead of the through-hole 12 illustrated in FIG. 1.

The first connector 51 is mounted on a first face 71A of the circuit board 71. Further, a cable 41 is connected to an end of the second connector 61 in the −Z direction.

Figure 19:
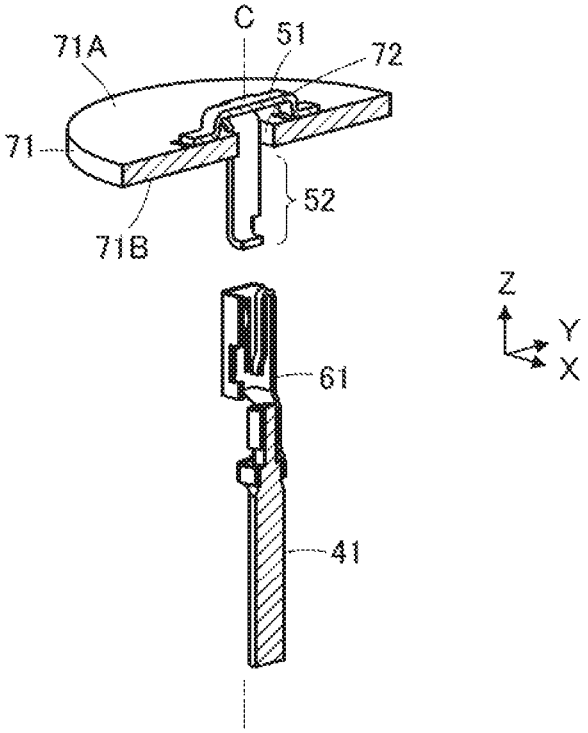
FIG. 19 is a perspective cross-sectional view of the connector assembly according to the second embodiment.

As illustrated in FIG. 19, a part of the first connector 51 passes through the through-hole 72 of the circuit board 71 and projects in the −Z direction on the side of a second face 71B of the circuit board 71 to form a projecting portion 52.

Figure 20:
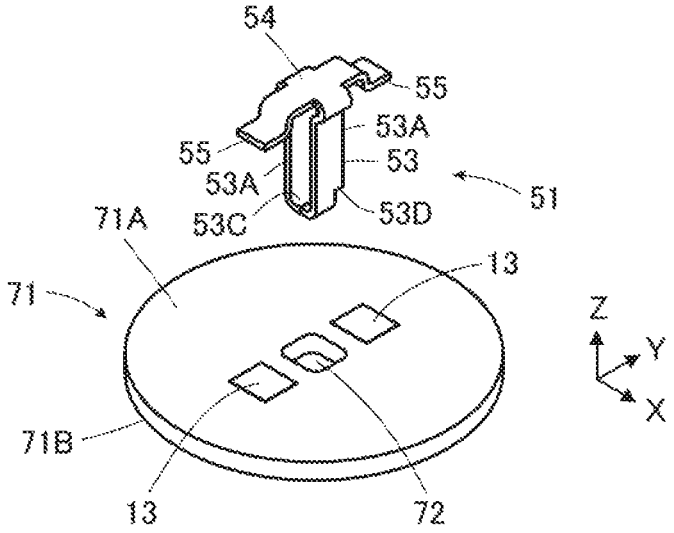
FIG. 20 is a perspective view for illustrating a first connector of the connector assembly according to the second embodiment before being fixed to a circuit board and the circuit board.

As illustrated in FIG. 20, two mounting pads 13 are formed in advance on the first face 71A of the circuit board 71 so as to sandwich the through-hole 72 in the Y direction.

The first connector 51 includes a first contact 53 extending in the Z direction, a top plate portion 54 connected to an end of the first contact 53 in the +Z direction and extending in the Y direction, and a pair of mounting portions 55 oriented in the −Z direction at both ends of the top plate portion 54 in the Y direction.

The first contact 53 has a pair of contact portions 53A that extend in the Z direction and are oriented in the +X direction and the −X direction, respectively. The contact portions 53A in the pair are connected to each other at their upper ends in the +Z direction. Further, each of the contact portions 53A in the pair has a flat plate shape extending along the YZ plane. Ends in the −Z direction of the contact portions 53A in the pair face each other in the X direction and are bent so as to be located along the XY plane, thereby forming an upward-facing face 53C that is oriented in the +Z direction. Further, a cutout portion 53D oriented in the +Y direction is formed at an end in the −Z direction of each contact portion 53A in the pair.

When the first connector 51 is inserted into the through-hole 72 of the circuit board 71, a part of the first contact 53 in the first connector 51 passes through the through-hole 72 and projects from the second face 71B of the circuit board 71 in the −Z direction to form the projecting portion 52.

In this process, the pair of mounting portions 55 in the first contact 53 are positioned on surfaces of their corresponding mounting pads 13 of the circuit board 71 and the mounting portions 55 are used as soldering portions to be soldered to their corresponding mounting pads 13, thereby mounting the first connector 51 on the circuit board 71 while electrically connecting the first connector 51 to the mounting pads 13.

Figure 21:
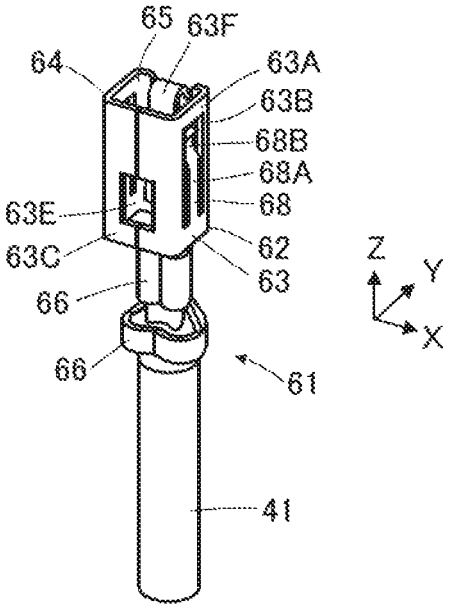
FIG. 21 is a perspective view for illustrating a second connector of the connector assembly according to the second embodiment.
Figure 22:
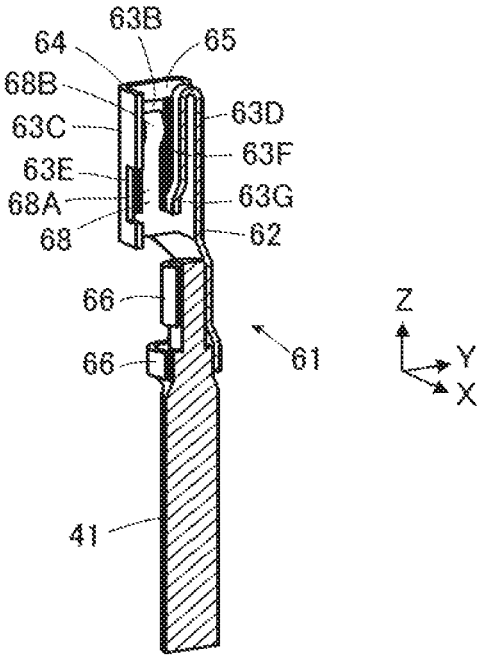
FIG. 22 is a perspective cross-sectional view for illustrating the second connector of the connector assembly according to the second embodiment.

As illustrated in FIG. 21 and FIG. 22, the second connector 61 has a second contact holding portion 62. The second contact holding portion 62 includes a lateral wall portion 63 that has a rectangular prism shape extending in the Z direction and is open in the +Z direction, and an abutment portion 64 that surrounds an opening portion of the lateral wall portion 63 and is formed to be located along the XY plane. A first connector receiving portion 65 extending in the Z direction is formed inside the lateral wall portion 63. A cable holding portion 66 for holding an end of the cable 41 in the +Z direction is formed at an end of the first connector receiving portion 65 in the −Z direction.

The lateral wall portion 63 includes a pair of first lateral walls 63A that face each other in the X direction. A pair of first openings 63B that extend in the Z direction and are open in the X direction are formed in the pair of first lateral walls 63A. A pair of second contacts 68 extending in the Z direction are connected to respective ends in the −Z direction of the first openings 63B in the pair.

The second contacts 68 in the pair have arm portions 68A that extend in the Z direction and form a pair. Contact portions 68B in the pair that project so as to face each other in the X direction are formed at respective ends in the +Z direction of the arm portions 68A in the pair. The arm portions 68A in the pair have elasticity and are configured to be elastically deformable on an XZ plane.

The lateral wall portion 63 also includes a second lateral wall 63C oriented in the −Y direction and a third lateral wall 63D oriented in the +Y direction. A second opening 63E that is open in the −Y direction is formed in the second lateral wall 63C. An extension portion 63F that is bent toward the inside of the first connector receiving portion 65 and extends in the −Z direction is formed at an end of the third lateral wall 63D in the +Z direction. A projection 63G projecting in the −Y direction is formed at an end of the extension portion 63F in the −Z direction. The extension portion 63F has elasticity and is configured to be elastically deformable on the YZ plane.

Each of the first connector 51 and the second connector 61 can be formed by subjecting a single metal sheet to cutting and bending.

Next, the operation of the connector assembly according to the second embodiment is described.

Figure 23:
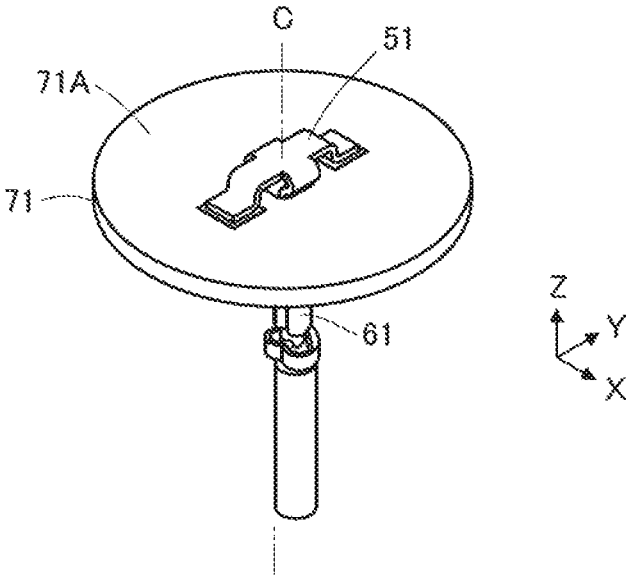
FIG. 23 is a perspective view for illustrating the connector assembly of the second embodiment after fitting and a first face of the circuit board.
Figure 24:
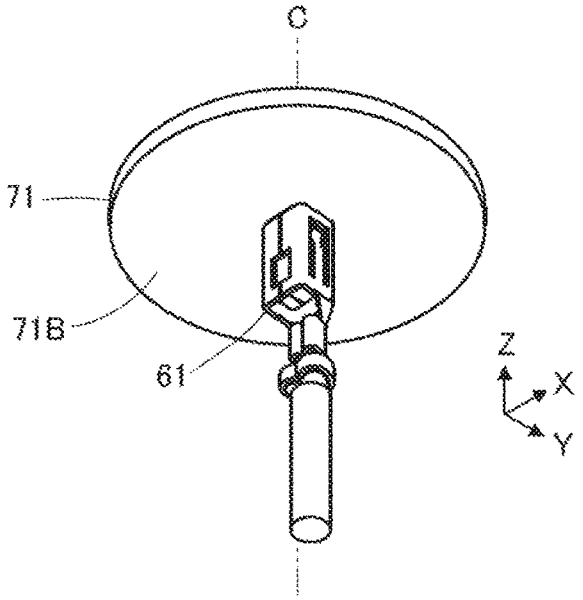
FIG. 24 is a perspective view for illustrating the connector assembly of the second embodiment after fitting and a second face of the circuit board.

When the second connector 61 is moved in the +Z direction along the fitting axis C from the second face 71B side of the circuit board 71 relative to the first connector 51 mounted on the circuit board 71, the second connector 61 is fitted to the first connector 51, as illustrated in FIG. 23 and FIG. 24.

When the second connector 61 is fitted to the first connector 51, first of all, the first connector receiving portion 65 of the second connector 61 starts to receive the projecting portion 52 of the first connector 51. Then, the contact portions 68B of the pair of second contacts 68 come into contact with an end of the first contact 53 in the −Z direction. Further, the arm portions 68A in the pair of second contacts 68 advance in the +Z direction while being pushed outward by the first contact 53, and the contact portions 68B in the pair of second contacts 68 come into contact with the pair of contact portions 53A in the first contact 53.

Figure 25:
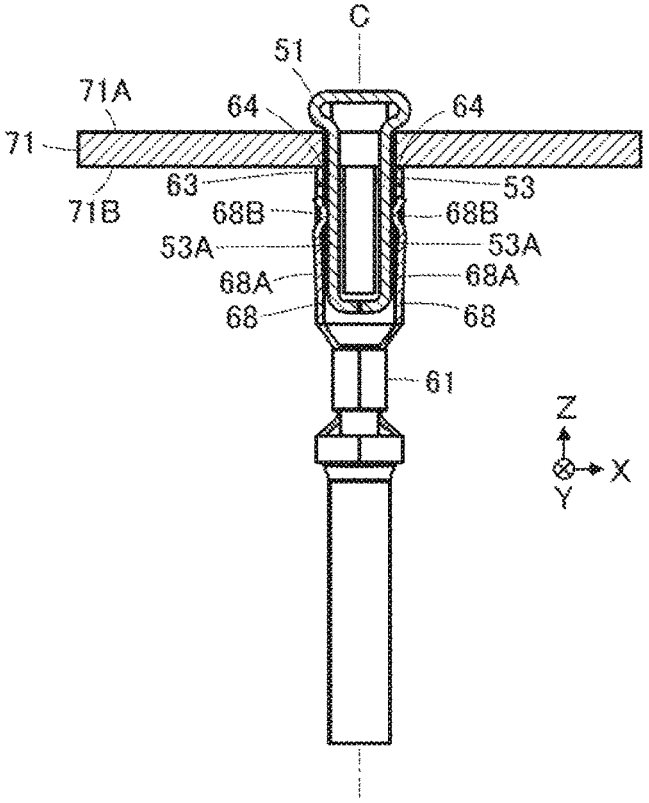
FIG. 25 is a lateral cross-sectional view of the connector assembly of the second embodiment after fitting.
Figure 26:
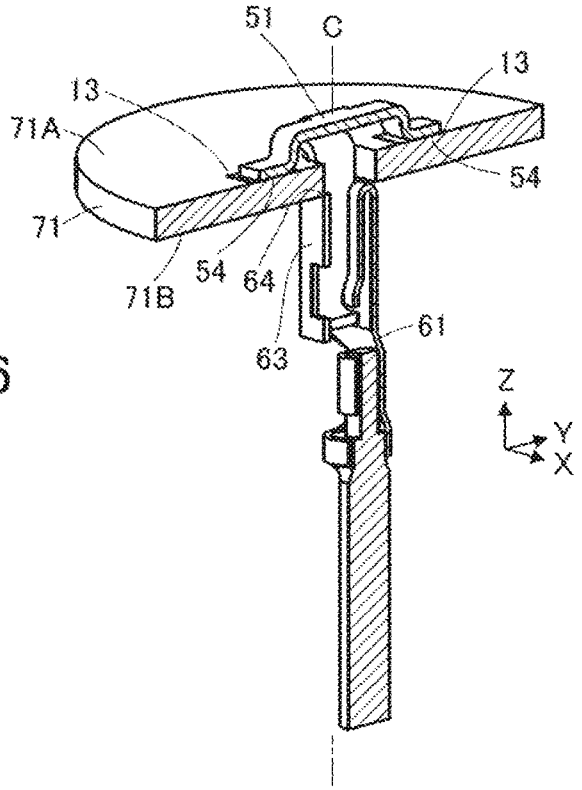
FIG. 26 is a perspective cross-sectional view of the connector assembly of the second embodiment after fitting.

Thereafter, the second connector 61 further advances in the +Z direction and, as illustrated in FIG. 25 and FIG. 26, at a point in time when the abutment portion 64 of the second connector 61 is abutted against the second face 71B of the circuit board 71, the projecting portion 52 of the first connector 51 is received in the first connector receiving portion 65 of the second connector 61 and fitting of the second connector 61 is completed.

When viewed from the fitting direction along the fitting axis C, the lateral wall portion 63 of the second contact holding portion 62 has a portion that covers the projecting portion 52 of the first connector 51 over the entire circumferential area.

The first contact 53 is sandwiched in the X direction between the elastic arm portions 68A of the pair of second contacts 68, and the contact portions 68B formed at the arm portions 68A are in elastic contact with the pair of contact portions 53A of the first contact 53. The second contacts 68 are thus electrically connected to the first contact 53. At that time, the contact points between the second contacts 68 and the first contact 53 are positioned on the second face 71B side of the circuit board 71.

When the second connector 61 is fitted to the first connector 51, the abutment portion 64 of the second connector 61 is abutted against the second face 71B of the circuit board 71 over the entire circumferential area when viewed from the fitting direction along the fitting axis C. Further, the first connector 51 and the second connector 61 are configured in such a manner that a part of the projecting portion 52 of the first connector 51 that is oriented in the −Z direction does not come into contact with any part of the second connector 61 during the fitting.

Therefore, when the second connector 61 is fitted to the first connector 51, such a large force as to push up the first connector 51 in the +Z direction is prevented from being exerted on the first connector 51 from the second connector 61. As a result, a large force that causes the mounting portions 55 as soldering portions of the first connector 51 to be separated from the mounting pads 13 of the circuit board 71 in the +Z direction is not exerted on the mounting portions 55, and the portions where the mounting portions 55 are soldered to the mounting pads 13 are prevented from being broken, whereby a reliable connector assembly can be realized.

Figure 27:
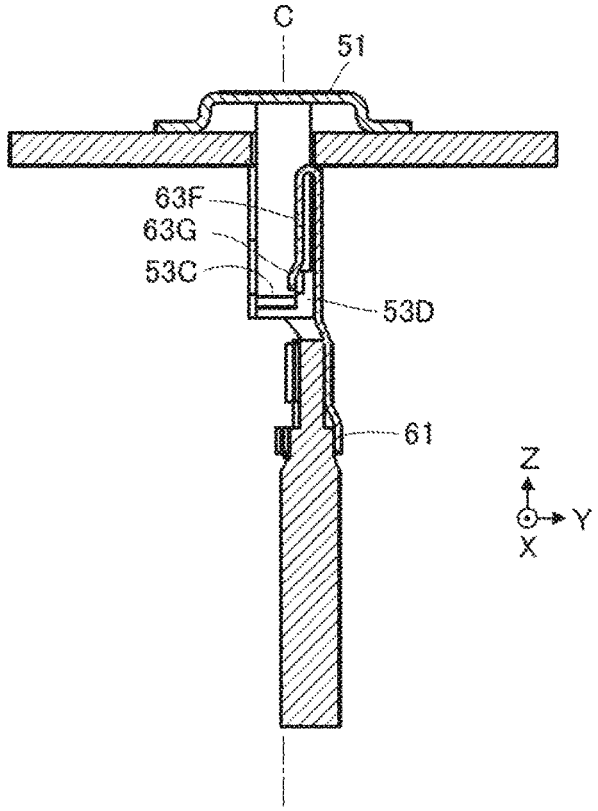
FIG. 27 is a lateral cross-sectional view for illustrating a retaining mechanism of the connector assembly according to the second embodiment.

Moreover, when the second connector 61 is fitted to the first connector 51, the extension portion 63F of the second connector 61 passes along the cutout portions 53D of the first connector 51 and the projection 63G of the second connector 61 is pressed by the first connector 51 to cause elastic deformation of the extension portion 63F, thus leading to displacement of the projection 63G in the +Y direction. Then, when the projection 63G advances in the +Z direction to pass the upward-facing face 53C of the first connector 51, the projection 63G is no longer pressed by the first connector 51, and is displaced in the −Y direction to be positioned immediately above the upward-facing face 53C in the +Z direction, as illustrated in FIG. 27. Therefore, even when a force in the −Z direction is exerted on the second connector 61 for some reason, the projection 63G is caught on the upward-facing face 53C to limit displacement of the second connector 61 in the −Z direction with respect to the first connector 51. Therefore, after the second connector 61 is fitted to the first connector 51, the second connector 61 is prevented from being separated from the first connector 51 in the −Z direction.

Figure 28:
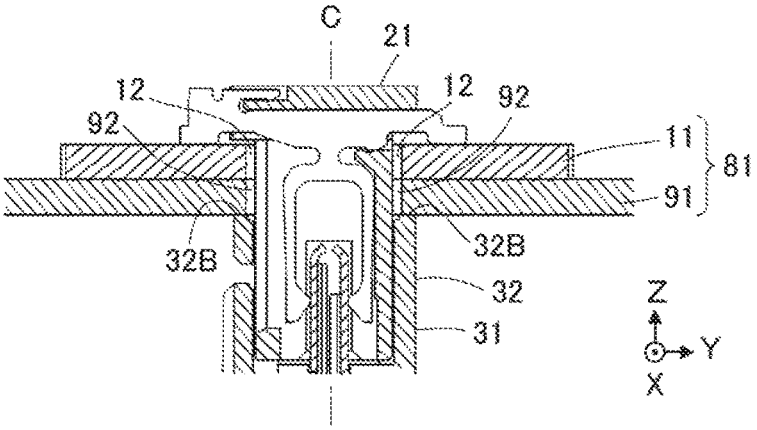
FIG. 28 is a lateral cross-sectional view for illustrating the circuit board mounted on a metallic chassis.

In the above-mentioned first embodiment, the circuit board 11 is used as the connector holding plate. However, as illustrated in FIG. 28, the circuit board 11 attached to other members such as a metallic chassis 91 may also be used as a connector holding plate 81.

The metallic chassis 91 can be fixed to the second face 11B of the circuit board 11 with an adhesive or a double-faced tape, or through connecting with screws. A through-hole 92 having the same size as the through-hole 12 formed in the circuit board 11 is formed in the metallic chassis 91.

In this case, when the second connector 31 is fitted to the first connector 21 mounted on the circuit board 11 which makes up the connector holding plate 81, the abutment portion 32B of the second housing 32 in the second connector 31 comes into abutment against a face of the metallic chassis 91 that is oriented in the −Z direction. Therefore, such a large force as to push up the first connector 21 in the +Z direction is prevented from being exerted on the first connector 21 from the second connector 31, thus keeping the portions where the first connector 21 is soldered to the circuit board 11 from being broken.

Figure 29:
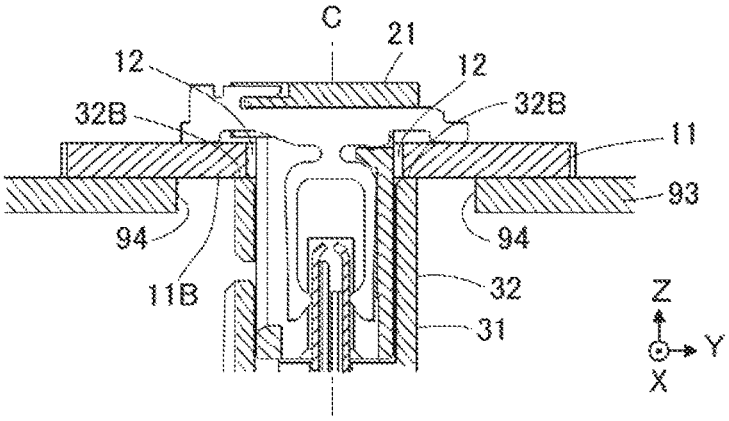
FIG. 29 is a lateral cross-sectional view for illustrating the circuit board mounted on another metallic chassis.
Figure 30:
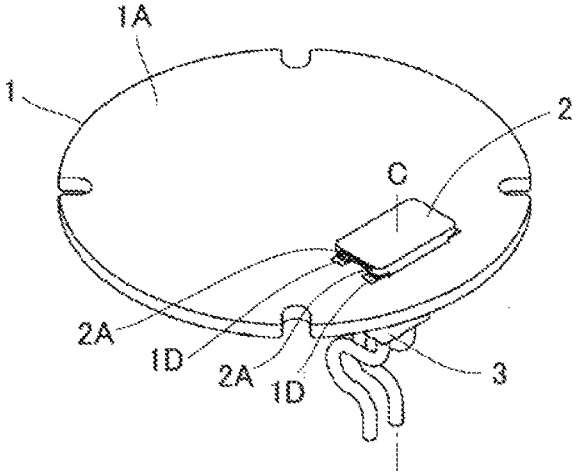
FIG. 30 PRIOR ART
FIG. 30 is a perspective view for illustrating a conventional connector assembly in a fitted state and a first face of a circuit board.
Figure 31:
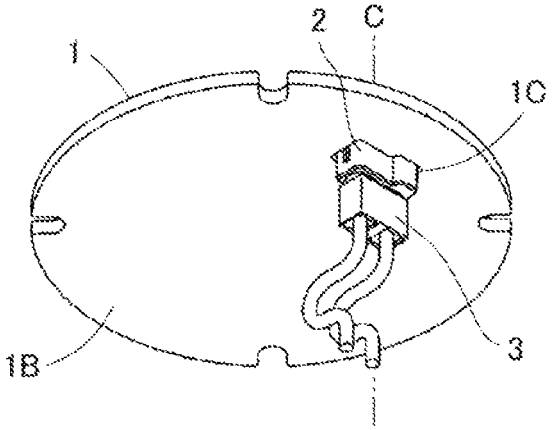
FIG. 31 PRIOR ART
FIG. 31 is a perspective view for illustrating the conventional connector assembly in the fitted state and a second face of the circuit board.
Figure 32:
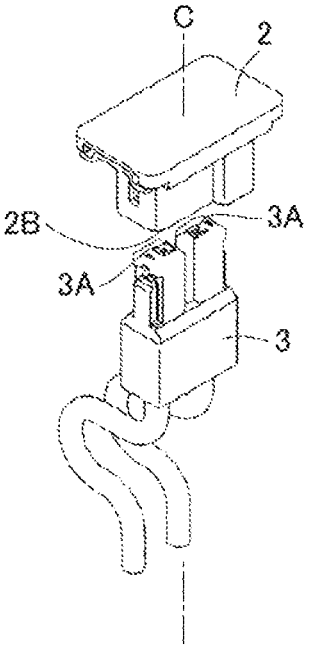
FIG. 32 PRIOR ART
FIG. 32 is a perspective view for illustrating the conventional connector assembly before fitting.

However, when the abutment portion 32B of the second connector 31 is abutted, as illustrated in FIG. 29, against the second face 11B of the circuit board 11 instead of a metallic chassis 93 during the fitting because the metallic chassis 93 fixed to the second face 11B of the circuit board 11 has a larger through-hole 94 than the abutment portion 32B of the second connector 31, only the circuit board 11 serves as the connector holding plate. In other words, as in the first embodiment, the abutment of the abutment portion 32B of the second connector 31 against the second face 11B of the circuit board 11 can prevent the portions where the first connector 21 is soldered to the circuit board 11 from being broken.

It is also possible to configure the circuit board 71 according to the second embodiment in the same manner as the structure illustrated in FIG. 28 by using the circuit board 71 attached to a metallic chassis or the like as the connector holding plate so that the abutment portion 64 of the second connector 61 is abutted against the face of the metallic chassis that is oriented in the −Z direction. With such a configuration, the portions where the first connector 51 is soldered to the circuit board 71 can be also prevented from being broken.

What is claimed is:

1. A connector assembly comprising: a first connector to be mounted on a first face of a connector holding plate having the first face and a second face which are oriented in opposite directions to each other; and a second connector to be fitted to the first connector along a fitting direction from a side of the second face of the connector holding plate, wherein the first connector has a first contact and a mounting portion, and has a projecting portion which passes through a through-hole of the connector holding plate to project on the side of the second face of the connector holding plate along the fitting direction when the first connector is mounted on the first face of the connector holding plate through the mounting portion, and which includes at least a part of the first contact, wherein the second connector has a second contact and a second contact holding portion configured to hold the second contact, and the second contact holding portion has a first connector receiving portion extending along the fitting direction and an abutment portion formed at an end of the second contact holding portion on a side of the first connector and configured to be abutted against the second face of the connector holding plate, and wherein, when the second connector is fitted to the first connector from the side of the second face of the connector holding plate, at least a part of the projecting portion is received in the first connector receiving portion to bring the first contact and the second contact into contact with each other, and the abutment portion of the second contact holding portion can be abutted against the second face of the connector holding plate.

2. The connector assembly according to claim 1, wherein a part of the projecting portion of the first connector oriented in the fitting direction does not come into contact with the second connector when the second connector is fitted to the first connector.

3. The connector assembly according to claim 2, wherein the second contact holding portion has a lateral wall portion and a bottom portion that make up the first connector receiving portion, wherein the abutment portion is formed by a face of the lateral wall portion oriented in the fitting direction, and wherein the part of the projecting portion oriented in the fitting direction does not come into contact with the bottom portion of the second contact holding portion when the second connector is fitted to the first connector.

4. The connector assembly according to claim 3, wherein, when the second connector is fitted to the first connector, the lateral wall portion of the second contact holding portion has a portion that covers the projecting portion of the first connector over an entire circumferential area when viewed from the fitting direction.

5. The connector assembly according to claim 4, wherein, when the second connector is fitted to the first connector, the abutment portion comes into abutment against the second face of the connector holding plate over the entire circumferential area when viewed from the fitting direction.

6. The connector assembly according to claim 1, wherein a contact portion between the first contact and the second contact is located on a side of the second connector with respect to the first face of the connector holding plate when the second connector is fitted to the first connector.

7. The connector assembly according to claim 1, wherein the connector holding plate comprises a board having a surface that serves as the first face, wherein the board has a mounting pad formed on the surface, and wherein the mounting portion of the first connector is a soldering portion which is formed integrally with the first contact and is to be soldered to the mounting pad of the board.

8. The connector assembly according to claim 1, wherein the first connector has a first housing formed of a different member from the first contact and configured to hold the first contact, wherein the projecting portion comprises a part of the first contact and a part of the first housing, and wherein the second contact holding portion of the second connector comprises a second housing formed of a different member from the second contact.

9. The connector assembly according to claim 1, wherein the projecting portion comprises a part of the first contact, and wherein the second contact and the second contact holding portion are formed of a single member.

10. A connector assembly mounted structure comprising:

a connector holding plate having a first face and a second face oriented in opposite directions to each other and having a through-hole formed therein;

a first connector having a first contact and a mounting portion, and mounted on the first face of the connector holding plate through the mounting portion; and a second connector having a second contact and a second contact holding portion configured to hold the second contact, the second connector being to be fitted to the first connector along a fitting direction from a side of the second face of the connector holding plate, wherein the first connector has a projecting portion which passes through the through-hole of the connector holding plate to project on the side of the second face of the connector holding plate along the fitting direction and which includes at least a part of the first contact, wherein the second contact holding portion of the second connector has a first connector receiving portion extending along the fitting direction and an abutment portion formed at an end of the second contact holding portion on a side of the first connector and configured to be abutted against the second face of the connector holding plate, and wherein, when the second connector is fitted to the first connector from the side of the second face of the connector holding plate, at least a part of the projecting portion is received in the first connector receiving portion to bring the first contact and the second contact into contact with each other, and the abutment portion of the second contact holding portion can be abutted against the second face of the connector holding plate.

* * * * *